US005129647A

United States Patent [19]

Castellanos

[11] Patent Number: 5,129,647

[45] Date of Patent: Jul. 14, 1992

[54] ELASTIC RESISTANCE EXERCISER SECURED AT THE WAIST

[76] Inventor: Edward Castellanos, 385 Midland Ave., Unit 14, Garfield, N.J. 07026

[21] Appl. No.: 633,319

[22] Filed: Dec. 24, 1990

[51] Int. Cl.[5] ..... A63B 21/02

[52] U.S. Cl. ..... 482/124; 482/139

[58] Field of Search ..... 272/126, 134, 135, 139, 272/142, 143, DIG. 9

[56] References Cited

U.S. PATENT DOCUMENTS

| | | | |
|---|---|---|---|
| 2,035,010 | 3/1936 | Rawlings | 272/142 |
| 3,751,031 | 8/1973 | Yamauchi . | |
| 3,999,752 | 12/1976 | Kupperman et al. . | |
| 4,073,489 | 2/1978 | Idstein et al. . | |
| 4,073,490 | 2/1978 | Feather . | |
| 4,121,822 | 10/1978 | DiSabatino et al. . | |
| 4,441,707 | 5/1984 | Bosch . | |
| 4,540,173 | 9/1985 | Hopkins, Jr. | 272/139 |
| 4,585,671 | 8/1987 | Hagerman et al. . | |
| 4,588,186 | 5/1986 | Calabrese . | |
| 4,993,705 | 2/1991 | Gerhard-Hugo Tolle . | |

FOREIGN PATENT DOCUMENTS

| | | | |
|---|---|---|---|
| 498504 | 12/1927 | Fed. Rep. of Germany | 272/139 |
| 150956 | 11/1931 | Switzerland | 272/142 |
| 20463 | 9/1907 | United Kingdom | 272/139 |

OTHER PUBLICATIONS

Joe Namath Power Bands Brochure-1990 Dynamic Classics, Ltd.

*Primary Examiner*—Richard J. Apley
*Assistant Examiner*—Lynne A. Reichard
*Attorney, Agent, or Firm*—Mathews, Woodbridge & Collins

[57] ABSTRACT

The present invention is an elastic resistance exerciser having at least one elastic resistance element secured at the abdomen, preferably at the waist; and most preferably at the sides at the waist. The elastic resistance element comprises two ends between which the elements can be stretched. A first end of the elastic resistance element is secured at the abdomen, preferably at least one side, and more preferably at the waist. A second end of the elastic resistance element can be secured or held at the extremity of a limb. The present invention also includes methods of using the exerciser.

13 Claims, 3 Drawing Sheets

ELASTIC RESISTANCE EXERCISER SECURED AT THE WAIST

BACKGROUND OF THE INVENTION

1. Field of the Invention

The present invention relates to an exerciser apparatus; more particularly, the present invention relates to an elastic resistance exerciser secured at the waist.

2. Description of Related Art

Elastic resistance exercise apparatus are well known and currently in widespread use. Particularly useful are large elastic bands, and tubes. These elastic bands and tubes are useful for exercising various parts of the body by holding one end of the elastic element in each hand and stretching. Alternately, as marketed under the trademark Power Bands®, bands or tubes can be connected to VELCRO® straps which are adapted to be fastened to the hands, wrists and/or the ankles. Exercise is achieved by stretching the hands apart or pulling against a hand against an ankle or ankles against ankles.

It is well known to use springs as an elastic means in exercising apparatus having handles at least one end of the spring against which a hand or foot can stretch against the spring resistance.

There is disclosed in the exercising art a variety of belt exercising devices. U.S. Pat. No. 4,685,671 discloses an elastomeric cord passing through a grommet on a strap attached to a belt with a grip at each end of the cord. This apparatus does not permit independent resistance to one outer hand or foot. Rather, hand straps are located at the ends of the same elastomeric tube. As such, the resistance along the tube is the interactive (push-pull) of the resistance at each end of the tube. The tube slides through the grommet located at the belt.

U.S. Pat. No. 3,999,752 discloses a push-pull exercising type device supported entirely by the body. This device includes a belt which is connected to cords. The cords are not secured to a location at the belt, but rather, each cord has two hand grips and passes around a pulley located at the belt so that the motion of one hand grip necessarily affects the other hand grip. The cords are not elastic in nature.

Another exercising device is an isometric exerciser belt for joggers and the like as disclosed in U.S. Pat. No. 4,441,707. In this device, a cord of a push-pull type having handles on each end passes through a tube mounted on a belt. The line is flexible and contains a handle on either end. There is no disclosure to secure a line between the belt and the hand grip. Rather, pulling on one hand grip necessarily pulls on the other.

Other apparatus having exercise means associated with a belt are disclosed in U.S. Pat. No(s). 3,751,031; 4,588,186; 4,073,490; 4,121,822 and 4,245,840.

SUMMARY OF THE INVENTION

For the purposes of the present invention the front, back, and sides refer to the relative parts of a person using the apparatus or practicing the methods of the present invention. The front of the apparatus corresponds to the front of a person; the side of the apparatus corresponds to either side of the person; and the back of the apparatus corresponds to the back of the person. Abdominal portion refers to the portion corresponding to the person extending from the upper hips to the chest. The waist of a person corresponds to the narrow part of the body between the ribs and the hips and can include the upper hips. When referring to the term waist with regard to an article of clothing, the waist is the part of the garment covering the waist of the body. The term outer means facing outward from the user, and the terms inner means facing toward the user. The term limb includes the arms and legs of a person.

The present invention is an elastic resistance exerciser having at least one elastic resistance element secured at the abdomen, preferably at the waist; and most preferably at the sides at the waist. The elastic resistance element comprises two ends between which the elements can be stretched. A first end of the elastic resistance element is secured at the abdomen, preferably at at least one side, and more preferably at the waist. A second end of the elastic resistance element can be secured or held at the extremity of a limb. The present invention also includes methods of using the exerciser.

A preferred embodiment of the elastic resistance exerciser comprises at least two elastic resistance elements secured to an article of clothing which comprises an abdominal portion. The clothing extends along at least a portion of each side, with the elastic resistance elements secured by a suitable means to the sides at the abdominal portion of the clothing. The preferred article of clothing is a belt.

The elastic resistance exerciser preferably comprises two elastic resistance elements. There is a means to secure the elastic resistance elements to each side of the abdominal portion of the article of clothing. The means to secure can be a hole or loop, preferably a fabric or metal loop which can have a spring snap means.

A preferred belt of the present invention has at least one elastic resistance element secured to each side. The elastic element is connected to the belt by the means to secure which in turn is connected to the belt. The means to secure is connected to the belt via through a pad. The pad can be connected to a stationary position on the belt to correspond to the sides of the wearer. More preferably, the pad is slidably connected to the belt so that the pads can be adjusted to a comfortable location on the user. The pads become stationary between the body of the person and the belt. The pads serve to anchor the elastic member in place as well as to provide padding between the user and the apparatus. The position of the pad enables the user to exercise with different angles between the limbs and the point where the element is connected to the pad.

Each pad comprises a longitudinal axis which corresponds to the axis of the belt and a transverse axis. The pad preferably contains a belt channel which is substantially parallel to the longitudinal axis of the pad. The belt slides through the belt channel. Each pad has an outer surface which faces away from the looped belt and an inner surface which generally faces toward the center of the loop. The channel is preferably along the outer surface so that the padding is between the belt and the user. In a most preferred embodiment each pad comprises a large surface lobe toward each longitudinal end connected by a narrower midsection. It has been found that the narrow midsection adjusts at the side and the two lobes drape toward the front and the back of the user providing comfortable support during an exercise or rehabilitation routine.

An alternate embodiment of a pad is one wherein the belt channel is an elongated strip fastened along one longitudinal edge to the outer surface of the pad. The opposite longitudinal edge is removably fastened by a suitable means such as hook and loop type fastener (i.e., VELCRO®), a zipper, snaps, or clips. The ends of the strip are open and permit a belt to slide between the strip and the pad. In this embodiment the pad can have a connector attached to it as in the above embodiment. Additionally, this pad can have corresponding VELCRO® attachments to the outer surface of one longitudinal end and the inner surface of the opposite longitudinal end. The pad can double as a means to wrap around a limb or piece of equipment with the belt channel used to hold an elastic means. A tube can be secured in the channel. Alternatively, a separate connector can be used.

The belt preferably has a means to open it which is most preferably a buckle, and yet more preferably a front release buckle for quick opening and closing. Belts can be made to fit any suitable waist size which are typically from 16 to about 48 inches. The belt is typically from about ¾ to 3 inches, and more preferably from 1 to 2 inches wide and is made of a comfortable moisture resistant material.

Any suitable elastic resistance element can be used with the article of the present invention with the elastic bands and tubes being most preferred. The tubes or bands can be continuous loops, i.e., enclosed forms, or linear segments. Where the elastic element is linear there is a first end and second end. Where the tube is in continuous enclosure such as a circle, the flattened enclosure is considered to have a first end and a second end. The first end is secured to the article by suitable means such as tying, or clipping. The second end can be secured or held at the extremity and the elastic element stretched as the second end is pulled away from the first end.

The present invention includes various articles of clothing which are useful with an elastic resistance exerciser. As long as there is an abdominal portion which extends along at least a portion of each side which is suitably supported by the article of clothing, there can be a means located there to secure at least one elastic resistance element to each side. The articles of clothing which can be selected from the group consisting of belts, pants, shirts, shorts, bodyshirts, jumpsuits and leotards. Each can have a fabric loop sewed there or can have a suitable metal loop or snap spring sewed to the side. In this way a tube or band can be looped through the fabric or metal loop or attached to the spring clip and a separate belt not be needed.

The present invention includes a method comprising the step of stretching at least one elastic resistance element between at least one stationary point secured at the abdomen, preferably the waist, and more preferably the side of the waist, and an extremity of at least one limb. Such extremity can include the ankle, foot, wrist or hand.

Where the elastic resistance element is secured at the article and connected to the hand extremity, the method comprises the steps of exercising the upper body with the exercises and independently exercising the lower body. Lower body exercising can include rehabilitative exercising as well as walking, jogging, aerobic dancing, aquatic aerobic dancing, cycling on a stationary exercise machine, exercising on stair machine and exercising using a treadmill.

Where the elastic resistance element is being stretched between the apparatus and the foot extremity, the method further comprises moving the foot relative to the waist to exercise parts of the lower body selected from the group consisting of stomach, buttocks, hips and legs.

The apparatus of the present invention and the method of using it present a new means and method of exercising the body. They permit exercise use of limb extremities independent of each other, thereby one hand can be used independent of the other hand and the feet. This enables this type of apparatus to be particularly useful for rehabilitative exercising. The apparatus also provides a convenient way to independently exercise the upper body while using the lower body in common-type of aerobic exercising including, jogging, walking and using stationary machines, such as treadmills, bicycles and stair machines.

The whole apparatus can be made of water resistant material and be used in aquatic aerobics. It permits the use of each limb independently or each limb in a coordinated exercise routine. This is particularly helpful during aerobic exercise where limbs occasionally move together and occasionally move apart. The resistance in the elastic material will be the same on each limb whether they are moved together or apart as opposed to the push-pull type resistance elements used in the prior art.

DESCRIPTION OF THE PREFERRED EMBODIMENTS

Figure 1:
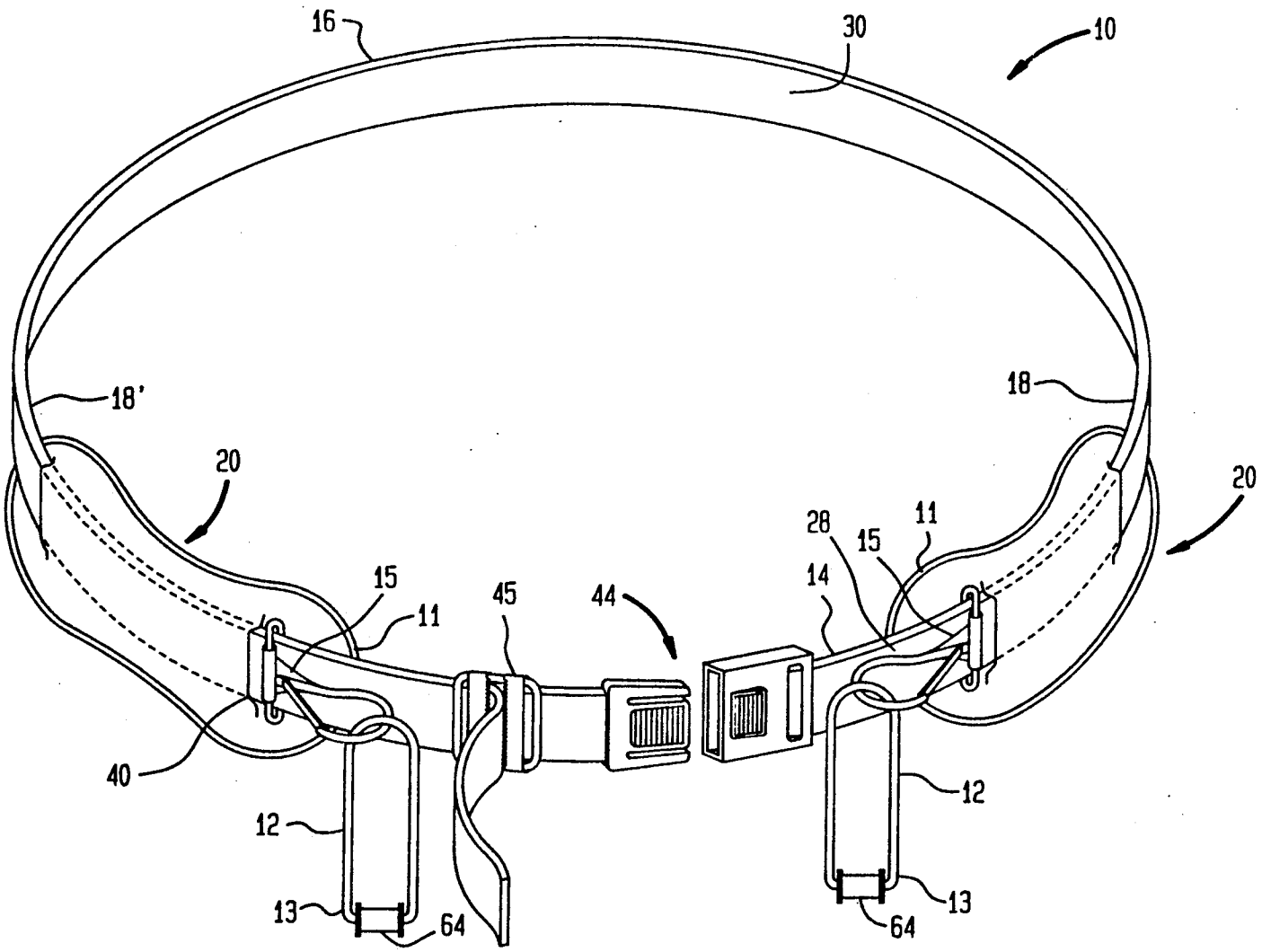
FIG. 1 is an assembled view of an embodiment of the present invention where elastic resistance elements are attached to a belt.

The apparatus and method of the preferred embodiment will be apparent to those skilled in the art by reference to the accompanying figures. Preferred embodiments of the present invention are illustrated in FIGS. 1–5 used in accordance with the method of the present invention.

The most preferred embodiment of the present invention is an article comprising a belt 10. There are at least two elastic resistance exercise elements 12 having first end 11 and second end 13, interconnected to belt 10. The belt 10 has a front 14, a back 16 and sides 18 and 18'. The belt 10 has at least one connector 15 connected to it having means to connect the belt to at least one elastic resistance element 12. Such connectors can include metal or fabric loops or metal spring snaps attached thereto.

There is preferably at least one pad 20 connected to the belt 10. Preferably the pad 20 is located on the belt so that the pads can be at sides 18 and 18'. The preferred pad 20 useful with the preferred belt of the present invention is a pad which can slide along the belt so that the pad can be adjusted for the comfort of the user as well as to enable the user to pull the elastic resistance element from different fixed positions along the belt, to create different angles for the muscles. The pads are preferably located at sides 18 and 18' during use.

Figure 2:
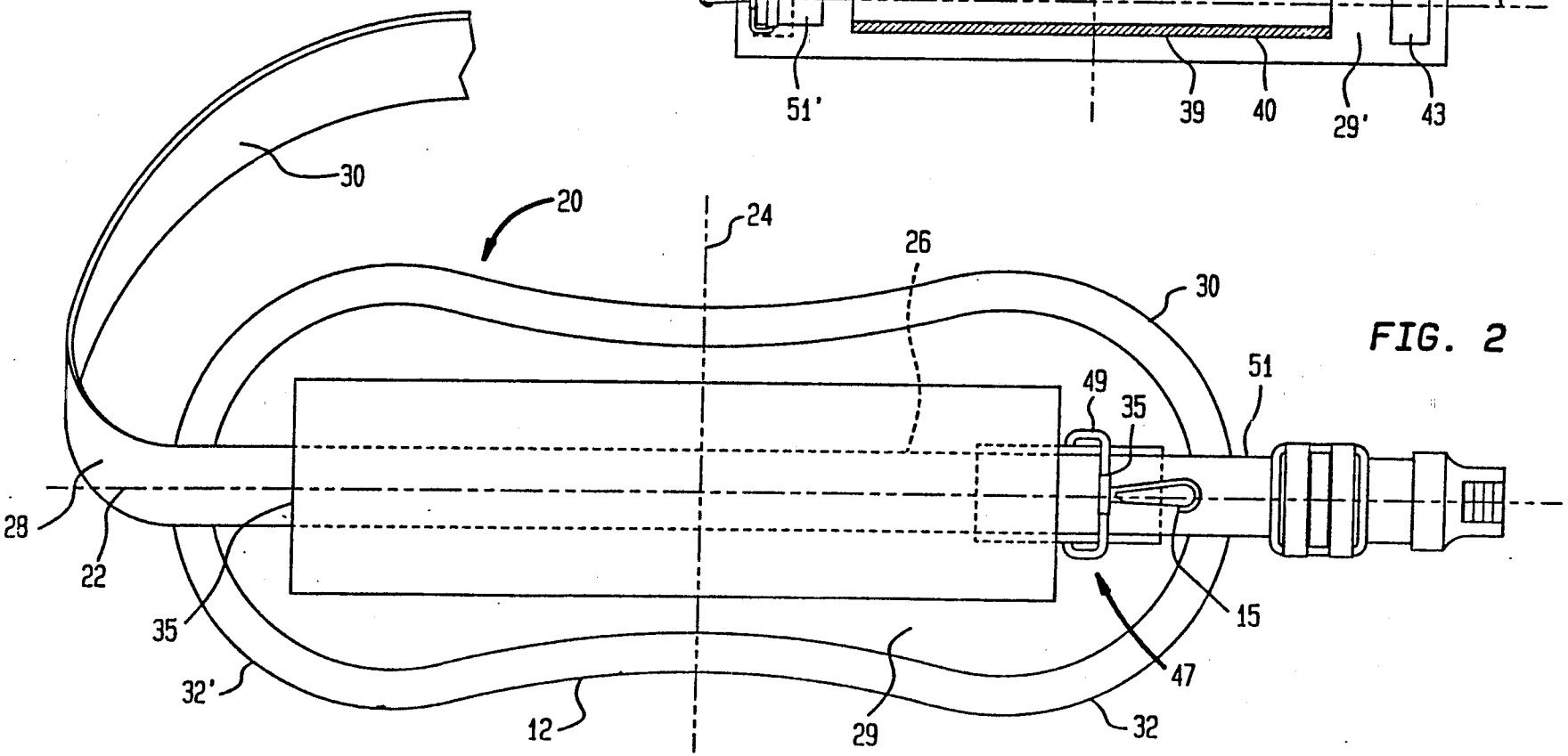
FIG. 2 is an enlarged drawing of a pad used in the embodiment of FIG. 1.

A preferred pad 20 is illustrated in detail in FIG. 2. The preferred pad has a longitudinal axis 22 and a transverse axis 24. The pad has a belt channel 26 substantially parallel to longitudinal axis 22. The belt 10 slides through the belt channel 26. The belt 10 has an outer face 28 shown in FIG. 2 and an inner face 30 illustrated in FIG. 1. When the belt 10 is formed into a loop substantially as shown in FIG. 1, the outer surface 28 faces away from the belt loop and the inner surface 30 faces toward the center of the belt loop. When the belt 10 is worn the inner surface faces and is adjacent to the person exercising and the outer surface faces away from the person exercising. Preferably belt channel 26 is located on or near the pad outer surface 29. The pad 20 preferably has padding in it such as material batting or foam to supply a cushion between the belt 10 and connector 15, and the user.

The preferred pad shown in FIG. 2 comprises lobes 32 and 32' towards each longitudinal pad end connected by a narrower midsection 34. The transverse o width at the widest part of lobes 32 and 32' is preferably from 3 to 6 inches; and the transverse width at the narrowest point in midsection 24 is preferably form abut 2 to 4 inches. The construction of this pad with the lobes 32 and 32' and the narrow pad midsection 34 permits the user to slide the pad to a location, preferably at the user's side, which is most comfortable. The narrow midsection 34 is positioned in the middle of the user's side and the two lobes are toward the front and back of the person.

The pad 20 can contain an open foam padding of high density foam to give a cushioning feeling when it is pressed against the waistline or hips. The foam is preferably a waterproof foam so that the pad can be used in water for aquatic exercising and can resist sweat during exercising. The pad can have a nylon resistance surface fabric which is also water resistant covering the outer surface and inner surface. Typically, the pad is from ⅛ to ½ inch thick with a preferred pad being approximately ⅜ to ⅝ inch thick. The pad can be made strong and attractive by having a trim 62 around the outer edge of the entire pad to connect the front and back surface cover between which the cushion padding is located.

The belt channel 26 can be sewn onto the outer surface 29 of the pad. Preferably the belt channel is made of the same type of fabric as the outer surface. Only the longitudinal edges of the belt channel 26 are sewn leaving openings 35 parallel to the transverse axis 24. The belt 10 can slide along the outer surface 29 through the opening 15 in the transverse ends of the belt channel. The belt also slides through the fixed loop eye 49 of the spring snap 47. The pads 20 can slide along the belt and be adjustable to any specific waistline for comfort and different location for muscle angle to the stationary point on the belt. There are preferably two pads 20 on every belt, one for each side. This gives the apparatus the ability to be used with each side independently.

Figure 3:
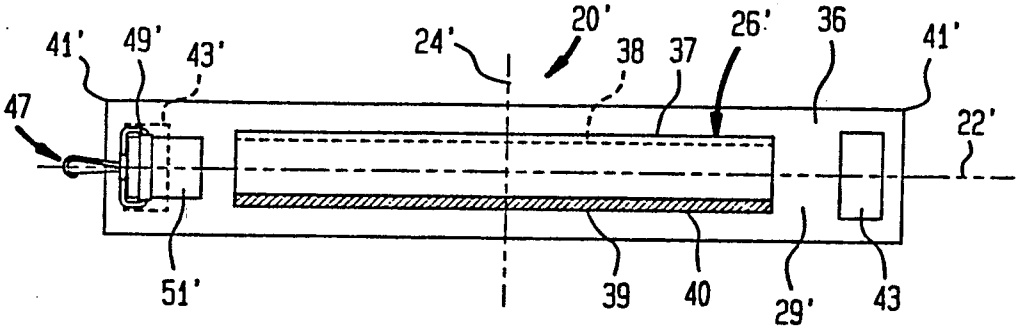
FIG. 3 is an alternate embodiment of a pad.

An alternative embodiment to the pad is a strip pad 20' illustrated in FIG. 3. This pad has a longitudinal 22' and a transverse axis 24'. This pad has a padded portion 36 and a belt channel generally shown as 26'. The belt channel 26' extends longitudinally along the longitudinal axis 22' of strip pad 20'. The channel is on the outer surface 29' of pad 20'. The pad 20' contains sufficient padding to provide a cushion between the belt channel 26 and the user. The belt channel 26, is secured along one longitudinal secured edge 37 by suitable means such as stitching 38. There is a detachable edge 39 which can be secured along at least part of the longitudinal edge 39. Preferably there is a longitudinal matching Velcro® strip between the padding and the detachable edge. Alternatively, it can be attached by a zipper, clips or other suitable means. In this way the belt channel can be opened and the pad removed without having to pull the belt through the channel. Optionally, there can be a suitable connector 15 means to connect an elastic resistance exerciser element to the belt such as spring snap 40 which is attached via fixed loop eye fabric strip 45.

The embodiment of pad 20' can also have means 43 and 43' to attach the longitudinal ends 41 and 41'. A preferred method to attach these ends is a Velcro® attachment with corresponding Velcro® parts on the outer surface 29' of end 41 and on the inner surface of end 41'. In this way the padding can be removed and formed into a loop for other uses. For example, it can be looped around a piece of equipment or the arm or leg of a body and elastic resistance element 12 attached spring snap 40. A length of the elastic element 12 can be placed in channel 26' of one or more pads. The pads 26' can be fastened at ends 41 and 41' around limbs or a limb and a stationary object.

The belt 10 preferably has a means to open such as belt buckle 44. The preferred belt buckle is a buckle with a front release buckle. The size of the belt can be adjusted with a sliding teeth bar 45. Light weight buckles can be made of plastics or metal. The belt can come in different sizes as regards to length and width. Belts can be used for people having waists from 16 inches to 48 inches with a common waist size range size being from 18 inches to 40 inches. A preferred belt is a 1¼ wide belt with a front release buckle with a sliding teeth bar 45. Belt 10 can be made in suitable sizes for different size people. The belt can be made of any number of different materials including fabrics, water-resistance fabrics, leather and plastics. The belt is typically ¾ wide to 3 inches wide and is preferably from 1 inch to 2 inches wide, a preferred belt is 1 to 1½ inches wide. The belts can be made of water resistance material as can be the pads and other part of the apparatus. Useful belt material includes nylon cloth, however, genuine top grade leather cowhide can be used. For underwater applications plastic belts can be used.

The means to secure can be connected to the outer surface 29 of pad 20. The means to secure can be any suitable connector 15 to connect the elastic resistance element to the belt via the pad 20. Preferred connector means include metal and fabric loops, and loops with the most preferred means being a snap spring.

Figure 4:
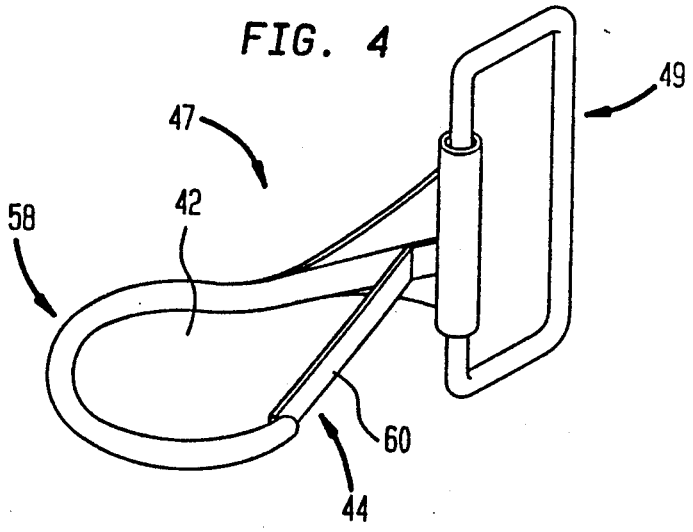
FIG. 4 is an enlarged drawing of a snap spring used in the embodiment of FIG. 1.

The preferred connector 15 is a spring snap as shown in detail in FIG. 4. The spring snap is desirable since the band need not be tied to the loop but merely inserted into the bill 58 when the spring 60 is depressed. The spring snaps can be made of any desirable material including plastic or metal, with metal being preferred. Preferred metals include alloys of copper and tin, such as bronze, and can also include nickel plated bronze. Also, springs can be made of aluminum and magnesium alloys which increase tensile strength and durability.

A spring snap connector 47 having a fixed loop eye 49 and a spring loop 42 is illustrated in FIGS. 1 and 4. The spring snap 47 can be sewn onto the outer surface of pad 20. A fabric strip 51 passes through a fixed loop eye 49 of the snap and is sewn onto the pad. Preferably, the fixed loop eye 47 or other attachment means is located at the longitudinal lobe 32 closest to buckle 44. In most exercises it is desirable for the elastic resistance element 12 to be secured at the side toward the front to accommodate movements of the hands and the feet forward from the side.

The elastic resistance elements 12 can be selected from any type of elastic element which can cause resistance upon movement of an outer limb holding one end of the elastic resistance element away from the point where it is secured on the waist. Useful and preferred elastic resistance elements include elastic tubes and bands, and most preferably elastic tubes. Springs can also be used with the present invention.

The most preferred elastic resistance element is a large elastic tube. The elastic resistance of the tube 8 depends on the diameter, wall thickness and composition of the tube. The wall thickness of the tubes vary from 0.04 to 0.1 inches. The diameter of the tube will also affect the resistance. The greater the cross-sectional area between the inner and outer diameters of the tubes the greater the resistance. Typical tubes have a diameter ranging from ⅛ of an inch to 1 inch, with preferred tubes being from ¼ to ¾ of an inch. The tubes can range in length from 10 to 24 inches with preferred tubes being from 12 to 18 inches in length. The tubes can be used as straight lengths, but are typically in continuous loops with the length being the length of the flattened loop being from the first end to the second end.

Where the elastic element is a band, the elastic resistance of the band depends on the width, thickness and composition of the band. The thickness of the tubes vary from 0.04 to 0.1 inches. The width of the band also affects the resistance. The greater the cross-sectional area of the band the greater the resistance. Typical bands have a width ranging from ⅛ of an inch to 1 inch, with preferred tubes being from ¼ to ¾ of an inch. The bands can range in length form 10 to 24 inches with preferred bands being from 12 to 18 inches in length. The bands can be used as straight lengths, but are typically in continuous loops with the length being the length of the flattened loop being from the first end to the second end.

The tubes and bands are preferably made of natural rubber or elastomeric material. The elastomeric material include compositions containing a variety of additives and fillers which can affect the elasticity of the tubes or bands as well as the hardness. As such, the composition of the tubes and bands can affect their the elastic resistance. The person exercising can determine with a minimum of experimentation which tubes or bands are satisfactory for the type and level of exercise to be used. Preferred tubes or bands can be made of rubber-based polymeric compositions including natural rubber, polyurethanes and synthetic rubbers such as neoprene, synthetic polyisoprene, polybutadiene rubbers, and thermoplastic elastomers. Cross-linked elastomeric materials are preferred. The composition of the tubes or bands will affect the hardness and elasticity of the tubes or bands. Typically, the band hardness will vary from 30 to 50 Shore Scale A Hardness durometer measurements.

Useful tubes are sold by Kent Latex Products, Inc. of Kent, Ohio. They are sold in sizes ranging from 1/32 to ¾ inch inner diameter. The tubes are reported to have a specified ASTM D-412 tensile strength of a minimum of 3500 psi, elongation to break of a minimum of 750%, modulus at 100% of a maximum of 120 psi. A Shore A durometer hardness of 35±5; and a Federal Test Method Standard 601 specific gravity of 0.95.

Useful bands are sold by B. F. Goodrich as Big Job Bands® listed in B. F. Goodrich, Big Job Bands®, The One man Band, IPD-86-RB-1, 1986. The bands have a width of from ¼ to 1½ inches, a thickness of from 1/16 to 3/30 and a nominal flat length of greater than 12 inches as listed for 12 to 40 inches. The band can be made from nitrite or natural rubber.

Figure 5:
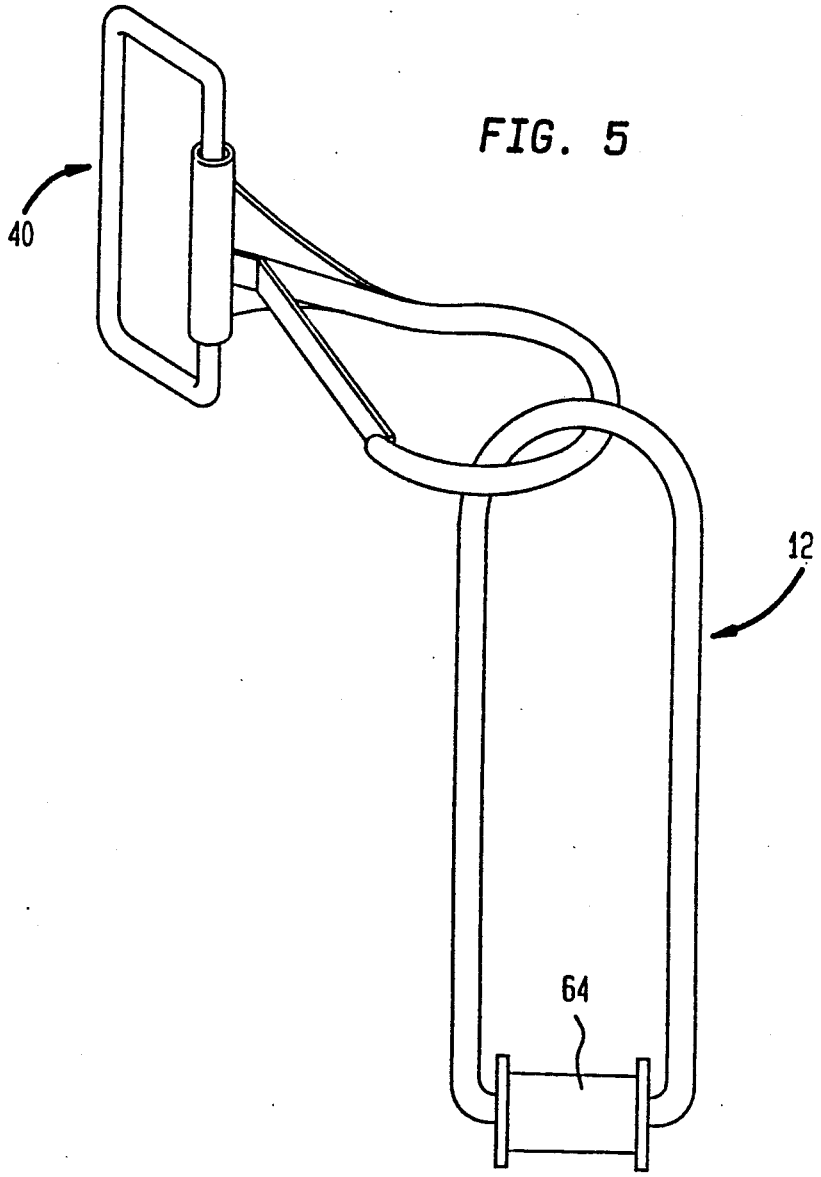
FIG. 5 is an enlarged view of the snap spring with an elastic band and a grip handle.

Optionally, there can be hand grips such as hand grips 64 illustrated in FIG. 5. The hand grip can be a tube through which the elastic resistance element passes. A useful hand grip is one at can wrap around the tube and be connected by a VELCRO®, a grommet, or other suitable releasable fastener.

The present invention has been described with regard to the most preferred embodiment, a belt 10. The present invention also comprises an articles of clothing preferably having an abdominal portion extending at least to a portion of each of the user's side, including shorts, bodysuits, jumpsuits, leotards and the like. The elastic resistance element can alternatively be secured at the abdomen, preferably at the waist, and most preferably at the side at the waist and can be held or secured the opposite end by an outer limb extremity such as a hand or a foot. These embodiments show the use of elastic elements, i.e., bands 12 with fabric loops at the upper hip or waists of pants. A shirt with a waistband can have fabric loops to which element 12 is connected. A shirt with a waistband can have fabric loops to which element 12 is connected.

The present invention also includes a method comprising the step of stretching at least one elastic resistance element between at least one stationary point secured at the abdomen, preferably at the waist and most preferably at the side of the waist, and the extremity of at least one limb including the ankle or wrist, or hand or foot, and preferably the hand or foot.

While exemplary embodiments of the invention have been described, the true scope of the invention is to be determined from the following claims.

What is claimed is:

1. An article comprising:

a belt;

at least one elastic resistance element having two ends between which the elastic resistance elements can be stretched, ;

at least one pad slidably connected to the belt;

at least one connector connected to the pad and having means to be connected to at least one elastic resistance exercise element, said at least one elastic resistance element connected at one end to said connector.

2. The art as recited in claim 1 wherein there are two pads.

3. The article as recited in claim 1 wherein said pad further comprises a longitudinal axis and a transverse axis, and a belt channel substantially parallel to the longitudinal axis, the belt sliding through the belt channel.

4. The article as recited in claim 3 wherein said pad has an outer surface and an inner surface and the channel is generally located adjacent to the outer surface when the belt is formed into a closed belt loop, the outer surface faces away from the belt loop and inner surface faces toward the center of the loop.

5. The article as recited in claim 4 where each pad further comprises a lobe toward each longitudinal end connected by a narrow midsection.

6. The article as recited in claim 4 where said at least one connector is connected to the outer surface of the pad.

7. The article as recited in claim 1 wherein there is means to open the belt.

8. The article as recited in claim 7 wherein the means to open the belt is a buckle.

9. The article as recited in claim 7 wherein the buckle is a front buckle.

10. The article as recited in claim 1 wherein there is at least one means to be connected selected from the group consisting of a fabric loop and a spring snap.

11. The article as recited in claim 1 wherein the belt fits a waist size from about 16 to about 48 inches.

12. The article as recited in claim 1 wherein the belt is from about ¾ to about 2 inches wide.

13. The article as recited in claim 1 wherein the elastic resistance exercise elements are selected from the group consisting of elastic bands, elastic tubes, and springs.

* * * * *